US005488830A

United States Patent [19]

Burt

[11] Patent Number: 5,488,830

[45] Date of Patent: Feb. 6, 1996

[54] ORIFICE PULSE TUBE WITH RESERVOIR WITHIN COMPRESSOR

[75] Inventor: William W. Burt, Hawthorne, Calif.

[73] Assignee: TRW Inc., Redondo Beach, Calif.

[21] Appl. No.: 328,333

[22] Filed: Oct. 24, 1994

[51] Int. Cl.[6] ..... F25B 9/00

[52] U.S. Cl. ..... 62/6; 62/467; 60/520

[58] Field of Search ..... 62/6, 467; 60/520

[56] References Cited

U.S. PATENT DOCUMENTS

| | | | |
|---|---|---|---|
| 3,817,044 | 6/1974 | Daniels | 62/6 |
| 3,902,328 | 9/1975 | Claudet | 62/6 |
| 4,398,398 | 8/1983 | Wheatley et al. | 62/467 |
| 4,846,861 | 7/1989 | Berry et al. | 62/6 |
| 4,858,441 | 8/1989 | Wheatley et al. | 62/6 |
| 4,953,366 | 9/1990 | Swift et al. | 62/467 |
| 5,172,554 | 12/1992 | Swift et al. | 62/6 |
| 5,269,147 | 12/1993 | Ishizaki et al. | 62/6 |
| 5,275,002 | 1/1994 | Inoue et al. | 62/6 |
| 5,294,355 | 3/1994 | Zhou et al. | 62/6 |
| 5,303,555 | 4/1994 | Chrysler et al. | 62/6 |
| 5,335,505 | 8/1994 | Ohtani et al. | 62/6 |
| 5,412,952 | 5/1995 | Ohtani et al. | 62/6 |

*Primary Examiner*—Christopher Kilner

[57] ABSTRACT

A cryogenic cooler of the pulse tube type is provided wherein the reservoir is disposed within the compressor housing. The invention provides the high efficiencies associated with orifice pulse tube cryogenic coolers, but is more compact and is generally lighter in weight than conventional pulse tube cryogenic coolers.

11 Claims, 3 Drawing Sheets

ORIFICE PULSE TUBE WITH RESERVOIR WITHIN COMPRESSOR

This invention was made with federal government support under Contract No. F29601-92-C-0055, awarded by the U.S. Air Force. The federal government, therefore, has certain rights in the invention.

FACTUAL BACKGROUND

This invention relates generally to cryogenic coolers and, specifically, to pulse tube coolers.

BACKGROUND OF THE INVENTION

Cryogenic coolers have been in common use for many years. One type of cryogenic coolers is a closed-cycle expansion cooler which provides cooling through the alternating compression and expansion of a gas. Typical closed-cycle expansion coolers of this type include coolers commonly termed "Stirling coolers," "Vuilleumier coolers," "Gifford-McMahon coolers," "Joule-Thomson coolers," and "pulse tube coolers."

Pulse tube coolers are particularly useful for applications aboard space craft because of their simplicity, reliability, and high efficiency.

One of the more efficient pulse tube coolers presently in use is an orifice pulse tube cooler. An orifice pulse tube cooler comprises a reservoir chamber disposed at the distal end of the pulse tube. The reservoir is in fluid tight communication with the pulse tube via a small orifice defined at the distal end of the pulse tube. Although orifice pulse tubes are considerably more efficient than conventional pulse tubes, the utility of orifice pulse tube coolers is limited by the additional installation volume and weight required by the addition of the reservoir.

There is therefore a need for an orifice pulse tube cooler which does not take up additional installation volume and weight over conventional pulse tube coolers.

SUMMARY OF THE INVENTION

The present invention satisfies this need. The invention is an orifice pulse tube cooler wherein the reservoir is disposed within the compressor housing. The inventor has noted that pulse tube cooler compressor housings typically comprise a certain amount of "dead space." In the invention, this "dead space" is efficiently utilized for the reservoir. This eliminates installation volume and weight normally associated with orifice pulse tube coolers of the prior art.

The invention comprises an electromechanical compressor, a regenerator, a pulse tube, a reservoir, means for removing heat from the cooler and means for transferring heat from a cooling load to the cooler. The compressor is disposed within a compressor housing, the pulse tube is disposed external of the compressor housing, and the reservoir is disposed within the compressor housing.

The means for removing heat from the cooler comprises one or more heat exchangers. Typically, the means for removing heat from the pulse tube will include an aftercooler heat exchanger disposed between the compressor and the regenerator and a hot end heat exchanger disposed between the pulse tube and the reservoir.

The means for transferring heat from a cooling load to the cooler is typically a cooling load heat exchanger disposed between the regenerator and the pulse tube.

The invention makes use of the compressor housing "dead volume" of prior art pulse tube coolers without sacrificing any efficiency. The invention is ideal for use within the close confines of a spacecraft where high efficiencies and low installation volumes and weights are extremely important. In mass-produced industrial applications, the invention provides important cost savings because of its use of fewer manufactured parts.

DESCRIPTION OF DRAWINGS

These and other features, aspects and advantages of the present invention will become better understood with reference to the following description, appended claims and accompanying drawings where:

DETAILED DESCRIPTION OF THE INVENTION

Pulse tube coolers and their operation are described in detail in U.S. Pat. No. 5,107,683 (Chan), the entire contents of which are incorporated herein by reference.

Figure 1:
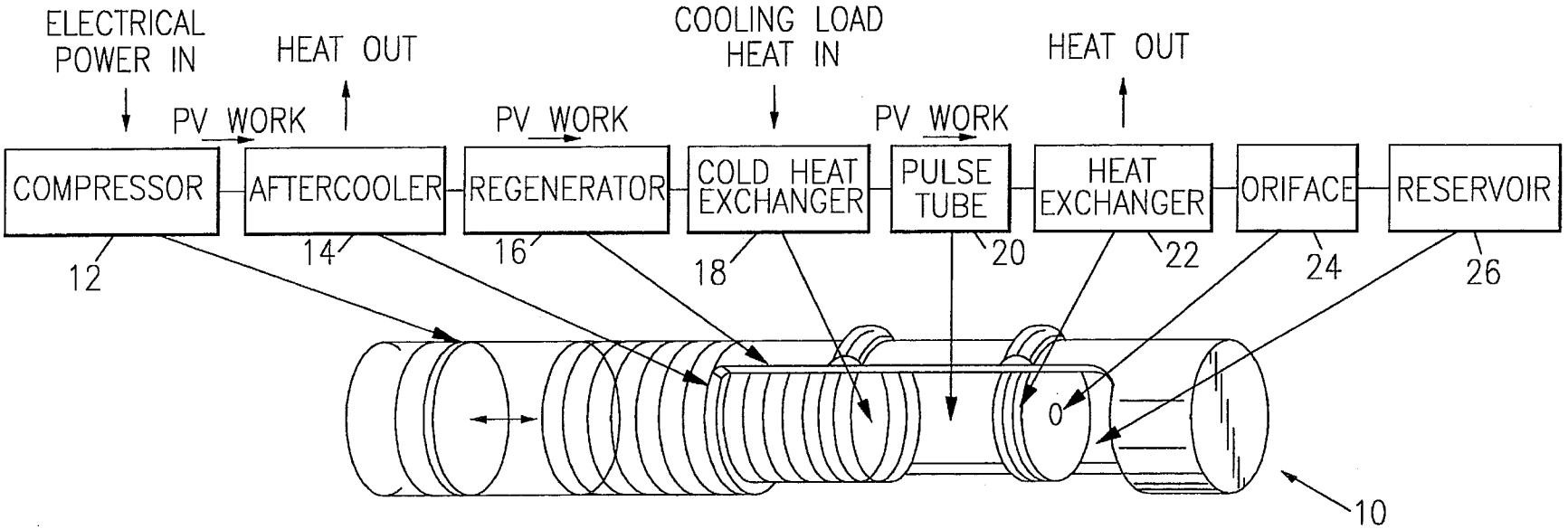
FIG. 1 PRIOR ART
FIG. 1 is a diagramatic view in partial cutaway of a pulse tube cooler of the prior art.

Referring to FIG. 1, a generalized pulse tube cooler 10 of the prior art is a simple heat pump which pumps heat from a cooling load to a heat sink, such as the ambient environment. An actual commercial pulse tube of the prior art is shown in FIG. 2.

Figure 2:
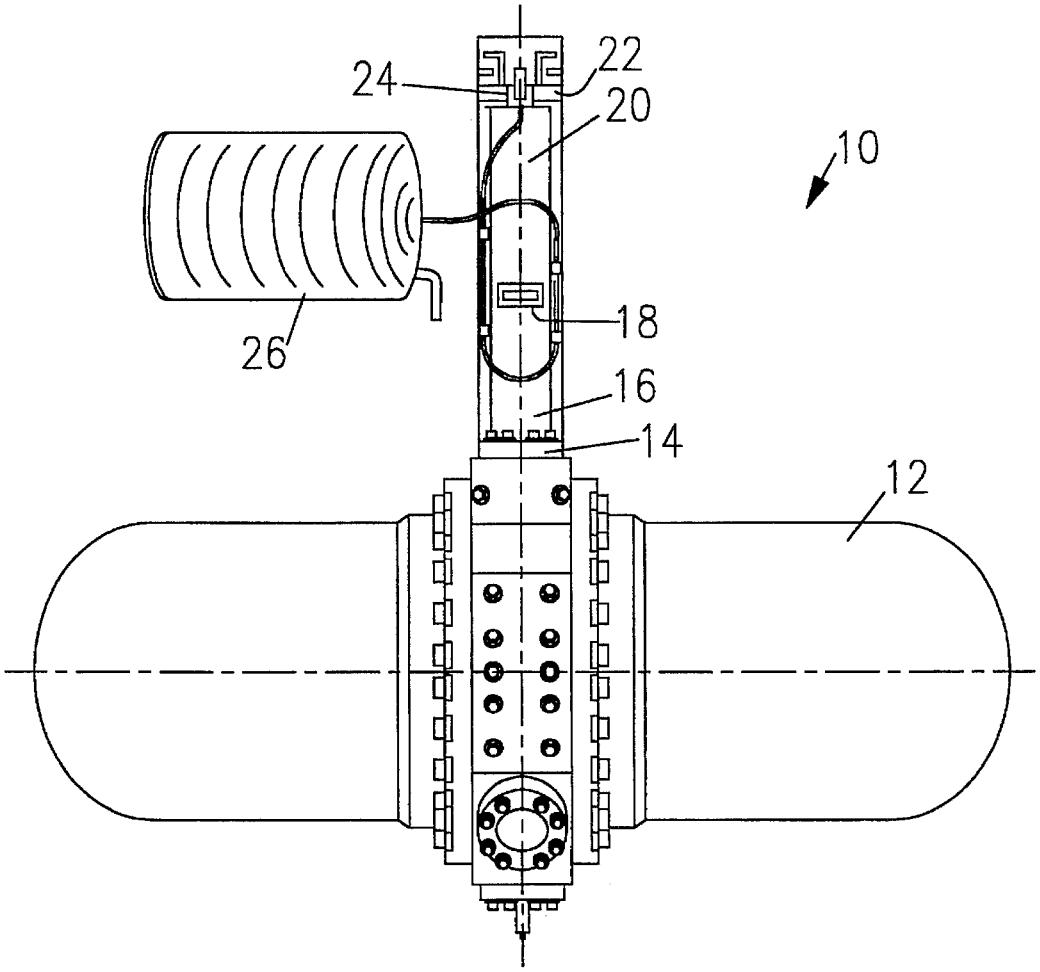
FIG. 2 PRIOR ART
FIG. 2 is a side view of a conventional pulse tube cooler of the prior art.

In the embodiment shown in FIGS. 1 and 2, the pulse tube cooler includes, in series, a pressure wave generator 12, an aftercooler 14, a regenerator 16, a cooling load heat exchanger 18, a pulse tube 20, a hot end heat exchanger 22 and a reservoir 26. When in operation, the pulse tube cooler is filled with a working gas, such as helium.

The pressure wave generator 12, which is the only component with moving parts, is typically an electromechanical compressor, such as a piston-type compressor.

The regenerator 16 acts as a thermal sponge, alternately absorbing heat from the working gas and rejecting excess heat to the working gas as the pressure waves travel back and forth. The regenerator 16 typically comprises a stack of screens. Packed spheres or parallel plates may also be used instead of the stacked screens. The regenerator must have a large heat capacity compared with that of the working gas. It must also have a low thermal conductivity to minimize conduction losses. The operating efficiency of the pulse tube cooler 10 depends in large part on the efficiency of the heat transfer between the regenerator 16 and the working gas. Thus, where the regenerator comprises a stack of screens, the efficiency of the regenerator 16 is determined by the screen mesh size and the materials used in fabricating the screens.

The pulse tube 20 is a thin-walled tube which has a low thermal conductivity. The distal end of the pulse tube 20 defines a central orifice. The central orifice allows fluid tight communication between the pulse tube 20 and a reservoir. The reservoir is an otherwise enclosed chamber.

The aftercooler 14, the cooling load heat exchanger 18 and the hot end heat exchanger 22 are typically stacks of screens of high thermal conductivity such as screens made of copper. These screens are thermally connected to copper blocks. The aftercooler 14 and the hot end heat exchanger 22 are typically cooled by heat conduction or heat pipe transport to a local radiator surface or by use of a forced flow coolant loop.

In operation, the pulse tube cooler 10 is filled with a working gas. The pressure wave generator 12 generates pressure waves within the working gas at a predetermined frequency. Each pressure wave travels the length of the pulse tube cooler 10 and into the reservoir 26. The compression of the gas initially increases the temperature of the gas to above ambient temperature. However, the heat of compression is substantially removed by the aftercooler 14. Thereafter, the gas is cooled to well below ambient temperature by contact with the regenerator and by expansion of the gas as it passes through it. The alternating pressure waves generated by the pressure wave generator 12 produce pressure/volume (PV) work which causes the regenerator 16 to pump heat from the cooling load (not shown) to a heat sink (also not shown). The result of this heat pumping action is to lower the temperature of the cooling load. Meanwhile, part of the PV work travels down the pulse tube 20, where it is rejected as heat to the heat sink by the hot end heat exchanger 22.

In operation, the reservoir provides a substantially isobaric chamber having an essentially constant pressure at its distal end. As an isobaric chamber, the reservoir establishes a boundary condition for the pulse tube. Pressure wave oscillations in contact with the proximal side of the central orifice are adjusted during manufacture to establish a constant pressure at the distal end of the reservoir. The creation and maintenance of this constant pressure is critical to the high cooling efficiencies characteristic of pulse tube coolers.

As shown in FIGS. 1 and 2, the reservoir 26 of a prior art orifice pulse tube cooler 10 is disposed at the distal end of the pulse tube 20. The reservoir 26, therefore, adds an additional installation volume and weight to orifice pulse tube coolers 10 of the prior art.

Figure 3:
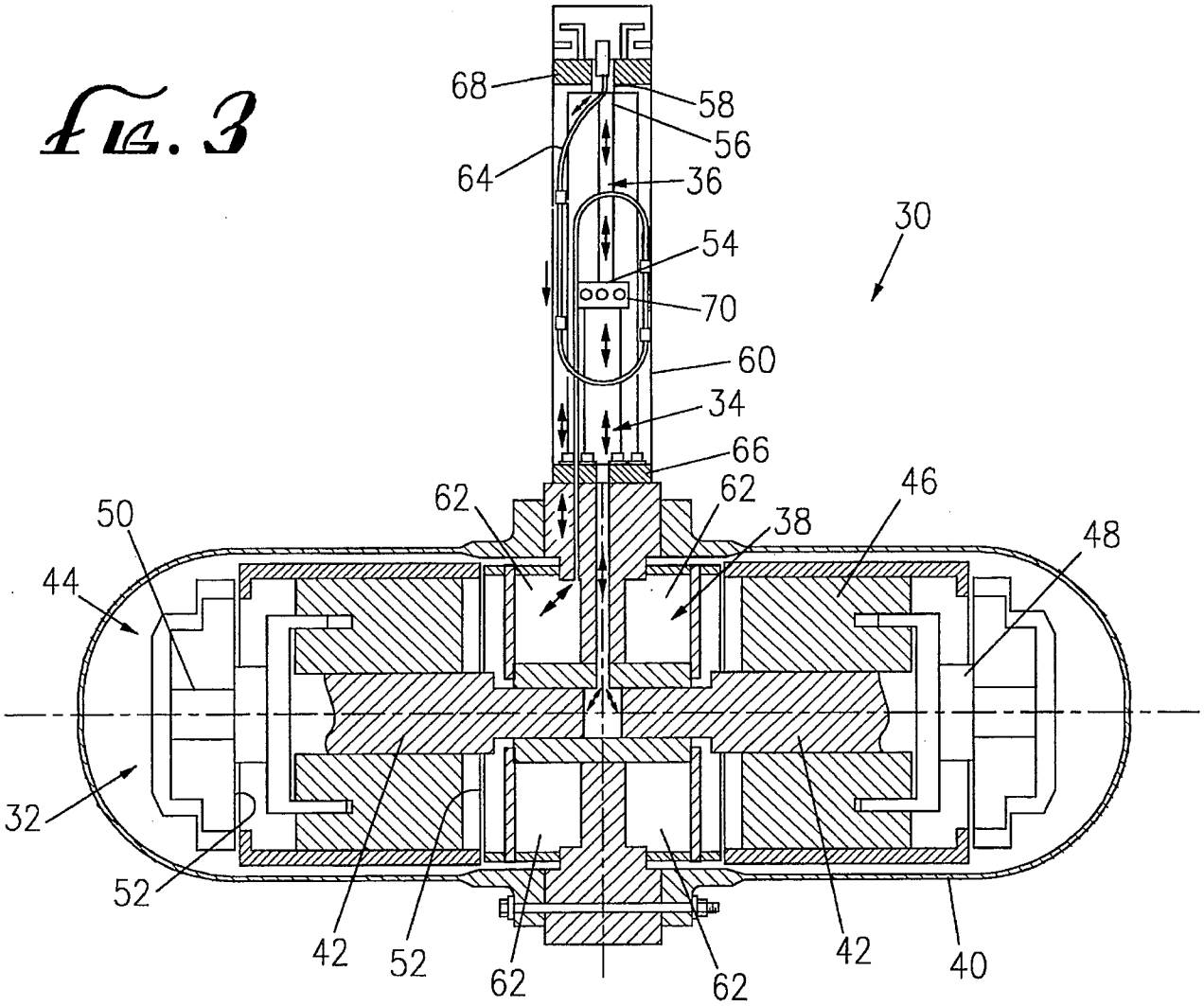
FIG. 3 is a side view in partial cutaway of a cooler having features of the invention.

In contrast, the reservoir of the improved pulse tube cooler of the invention is disposed within the compressor housing. The invention takes advantage of the "dead volume" which typically exists in prior art compressor housings, to locate the reservoir. A typical embodiment of the invention 30 is illustrated in FIG. 3. The invention 30 comprises an electromechanical compressor 32, a regenerator 34, a pulse tube 36, a reservoir 38, heat removal means for removing heat from the cooler, and heat transfer means for transferring heat from a cooling load to the cooler.

The electromechanical compressor 32 is disposed within a compressor housing 40. In the embodiment shown in FIG. 2, the electromechanical compressor 32 is a piston-type compressor having a pair of reciprocating pistons 42. The pistons 42 are driven by an electrical motor 44 having a linear motor stator 46, a linear motor armature 48, a capacitive position sensor 50 and flexible bearings 52. Other electromechanical-type compressors known to the art can also be used in the invention.

The regenerator 34 is disposed in fluid tight communication with the compressor 32. In the embodiment illustrated in FIG. 2, the regenerator 34 is disposed external of the compressor housing 40.

As in pulse tube coolers of the prior art, the regenerator 34 used in the invention 30 typically comprises a stack of screens. Packed spheres or parallel plates may also be used instead of the stack screens. The regenerator 34 typically is adapted to absorb heat from working gas having a temperature warmer than the regenerator 34 and to reject heat to working gas having a temperature cooler than the regenerator 34. The regenerator 34 must have, therefore, a large heat capacity compared to that of the working gas. It must also have a low thermal conductivity to minimize conduction losses.

The pulse tube 36 has a proximal end 54 in fluid tight communication with the regenerator 34 and a distal end 56. As in pulse tube coolers of the prior art, the pulse tube 36 used in the invention 30 is a thin-walled tube having a low thermal conductivity. The distal end wall 56 of the pulse tube defines an orifice 58.

In the embodiment illustrated in FIG. 2, the regenerator 34 and the pulse tube 36 are disposed within a support structure 60 which is disposed external of the compressor housing 40.

Defined within the compressor housing 40 is a reservoir 38 comprised of one or more chambers 62. The embodiment illustrated in FIG. 2 comprises two interconnected toroidal reservoir chambers 62. These reservoir chambers 62 are in fluid tight communication with the pulse tube 36 via a return line conduit 64 installed within the orifice 58 defined in the pulse tube distal end wall 56. Typically, the reservoir 38 has an internal volume between about 10 cc and about 1,000 cc.

In the embodiment illustrated in FIG. 2, the heat removal means are provided by an aftercooler 66 and a hot end heat exchanger 68. The aftercooler 66 is disposed in fluid tight communication between the compressor 32 and the regenerator 34. The hot end heat exchanger 68 is disposed in fluid tight communication between the pulse tube 36 and the reservoir 38. The aftercooler 66 and the hot end heat exchanger 68 are adapted to remove heat from the working gas and discharge that heat to a heat sink (not shown). The aftercooler 66 and the hot end heat exchanger 68 are typically cooled by heat conduction or heat pipe transport to a local radiator surface or by use of a forced flow coolant loop (not shown).

The heat transfer means can be provided by a cooling load heat exchanger 70. As illustrated in FIG. 2, the cooling load heat exchanger 70 is typically disposed in fluid tight communication between the regenerator 34 and the pulse tube 36. The cooling load heat exchanger 70 is adapted to absorb heat from a cooling load (not shown) and reject that heat to a working gas within the cooler 30.

The aftercooler 66, the cooling load heat exchanger 70 and the hot end heat exchanger 68 are typically stacks of screens of high thermal conductivity such as screens made of copper. These screens are thermally connected to copper blocks.

Many other forms of the invention exist, each differing in matters of detail only, Accordingly, it should be apparent that numerous structural modifications and adaptations may be resorted to without departing from the scope and fair meaning of the instant invention as set forth hereinabove and as described hereinbelow by the claims.

What is claimed is:

1. A cryogenic cooler of the orifice pulse tube type comprising:

(a) an electromechanical compressor disposed within a compressor housing;

(b) a regenerator disposed in fluid tight communication with the compressor;

(c) a pulse tube having a proximal end in fluid tight communication with the regenerator and a distal end defining an orifice, the pulse tube being disposed external of the compressor housing;

(d) a reservoir disposed in fluid tight communication with the distal end of the pulse tube via the orifice; and (e) heat transfer means for transferring heat from a cooling load to the cryogenic cooler;

(f) heat removal means for removing heat from the pulse tube cooler;

wherein the reservoir is disposed within the compressor housing.

2. The cryogenic cooler of claim 1 wherein the electromechanical compressor is a piston-type compressor.

3. The cryogenic cooler of claim 1 wherein the reservoir has an internal volume between about 10 cc about 1,000 cc.

4. The cryogenic cooler of claim 1 wherein the reservoir is in fluid tight communication with the distal end of the pulse tube via a return line conduit.

5. The cryogenic cooler of claim 1 wherein the heat transfer means comprises a cooling load head exchanger disposed in fluid tight communication between the regenerator and the pulse tube.

6. The cryogenic cooler of claim 1 wherein the heat removal means comprises an aftercooler heat exchanger disposed in fluid tight communication between the compressor and the regenerator.

7. The cryogenic cooler of claim 1 wherein the heat removal means comprises a hot side heat exchanger disposed in fluid tight communication between the pulse tube and the reservoir.

8. A cryogenic cooler of the orifice pulse tube type comprising:

(a) an electromechanical compressor disposed within a compressor housing;

(b) a regenerator;

(c) a pulse tube disposed external of the compressor housing;

(d) a reservoir;

(e) an aftercooler heat exchanger disposed in fluid tight communication between the compressor and the regenerator, the after cooler being adapted to remove heat from the cryogenic cooler and discharging that heat to a heat sink;

(f) a cooling load heat exchanger disposed in fluid tight communication between the regenerator and the pulse tube, the cooling load heat exchanger being adapted to transfer heat from a cooling load to the cryogenic cooler; and (g) a hot side heat exchanger disposed in fluid tight communication between the pulse tube and the reservoir;

wherein the reservoir is disposed within the compressor housing.

9. The cryogenic cooler of claim 8 wherein the electromechanical compressor is a piston-type compressor.

10. The cryogenic cooler of claim 8 wherein the reservoir has an internal volume between about 10 cc and about 1,000 cc.

11. The cryogenic cooler of claim 8 wherein the reservoir is in fluid tight communication with the distal end of the pulse tube via a return line conduit.

* * * * *